US006205979B1

(12) United States Patent
Sims, Jr. et al.

(10) Patent No.: US 6,205,979 B1
(45) Date of Patent: Mar. 27, 2001

(54) SPRING LOCATOR FOR DAMPING DEVICE

(75) Inventors: Dewey M. Sims, Jr., Wayne; Paul L. Rossi, Waterford; Kenneth O. Jahr, West Bloomfield; William T. Harvey, Brighton; Shari F. Stottler, Milford; Kevin A. Grabowski, Brighton, all of MI (US); Helmut G. Schwegler, Pleidelsheim; Wolfgang B. Weinbrecht, Pforzheim, both of (DE)

(73) Assignee: Robert Bosch Corporation, Broadview, IL (US)

( * ) Notice: Subject to any disclaimer, the term of this patent is extended or adjusted under 35 U.S.C. 154(b) by 0 days.

(21) Appl. No.: 09/449,164

(22) Filed: Nov. 24, 1999

Related U.S. Application Data

(60) Provisional application No. 60/109,632, filed on Nov. 24, 1998.

(51) Int. Cl.[7] ..... F02M 33/04
(52) U.S. Cl. ..... 123/456; 123/467
(58) Field of Search ..... 123/456, 467, 123/468, 469; 138/30

(56) References Cited

U.S. PATENT DOCUMENTS

| | | | |
|---|---|---|---|
| 1,058,572 | 4/1913 | Finlay . | |
| 2,599,325 | 6/1952 | Fritzberg . | |
| 3,227,147 | 1/1966 | Gossiaux . | |
| 4,056,679 | 11/1977 | Brandt et al. | 174/13 |
| 4,295,452 | 10/1981 | Lembke et al. | 123/470 |
| 4,649,884 | 3/1987 | Tuckey | 123/457 |
| 4,651,781 | 3/1987 | Kandelman | 138/30 |
| 4,660,524 | 4/1987 | Bertsch et al. | 123/468 |
| 5,024,198 | 6/1991 | Usui | 123/468 |
| 5,058,627 | 10/1991 | Brannen | 138/27 |
| 5,374,169 | 12/1994 | Talaski | 417/540 |
| 5,505,181 * | 4/1996 | McRae et al. | 123/456 |
| 5,538,043 | 7/1996 | Salazar | 138/26 |
| 5,570,762 | 11/1996 | Jentsch et al. | 188/322.15 |
| 5,575,262 | 11/1996 | Rohde | 123/467 |
| 5,607,035 | 3/1997 | Fulks et al. | 188/322.19 |
| 5,617,827 | 4/1997 | Eshleman et al. | 123/456 |
| 5,620,172 | 4/1997 | Fulks et al. | 267/221 |
| 5,687,958 | 11/1997 | Renz et al. | 267/136 |
| 5,845,621 * | 12/1998 | Robinson et al. | 123/456 |
| 5,894,861 * | 4/1999 | Lorraine | 138/30 |
| 5,896,843 * | 4/1999 | Lorraine | 123/467 |

* cited by examiner

*Primary Examiner*—Thomas N. Moulis
(74) *Attorney, Agent, or Firm*—Michael Best & Friedrich LLP

(57) ABSTRACT

A fuel rail assembly comprising a fuel rail and a damper assembly in the fuel rail. The damper assembly includes a damper having an end and an inner surface defining a cavity, and a sealing member at least partially received in the end and bonded to the inner surface to substantially seal the cavity. The sealing member is preferably a metal wire that includes a sealing portion bonded to the inner surface to substantially seal the cavity. The bond is preferably formed by induction brazing, and the sealing member is coated with copper to facilitate the brazing. The invention also provides a fuel rail assembly comprising a fuel rail having a longitudinal axis and an inner wall. A damper assembly in the fuel rail includes a damper, and a spring locator coupled with the damper, the spring locator having two positioning portions outwardly biased to engage the inner wall of the fuel rail and position the damper assembly axially in the fuel rail. The spring locator is preferably a metal wire. Most preferably, the sealing member and the spring locator are the same device that both seals the damper and locates the damper assembly inside the fuel rail.

24 Claims, 4 Drawing Sheets

SPRING LOCATOR FOR DAMPING DEVICE

RELATED APPLICATION

This application claims the benefit of U.S. Provisional Application No. 60/109,632, filed Nov. 24, 1998.

FIELD OF THE INVENTION

The invention relates to fuel rails for the fuel system of an internal combustion engine, and more particularly to dampers located within the fuel rails.

BACKGROUND OF THE INVENTION

A fuel rail supplies fuel to a plurality of fuel injectors that inject the fuel into the corresponding combustion chambers of the engine. Electromagnetic fuel injectors deliver fuel to the engine in metered pulses which are appropriately timed to the engine operation. The sequential energization of the fuel injectors induces pressure pulsations within the fuel rail that create various problems, including improper fuel distribution to the injectors, which can adversely affect tailpipe emissions and driveability, and fuel line hammering which results in vibration and audible noise.

It is known to utilize a damper inside the fuel rail to effectively minimize or dampen the pressure pulsations created by the fuel injectors. U.S. Pat. No. 5,617,827 issued Apr. 8, 1997 discloses such a damper. Two shell halves are welded together to form a damper having a sealed airspace disposed between two compliant side walls. The peripheral weld seals the airspace. The damper is positioned and held within the fuel rail using two damper supports. One of the supports is keyed and corresponds to a positioner in the circumference of the fuel rail to prevent rotation of the damper. These support structures are often difficult and expensive to make due to the intricate slots, grooves and keys required to receive the damper and maintain proper positioning. Also, the fuel rail itself must be specially designed to accommodate the support structures and damper. This may lead to larger fuel rails than are otherwise needed.

SUMMARY OF THE INVENTION

The invention provides a simple and inexpensive fuel rail assembly with a damper having an improved seal. The invention also provides an improved method for locating the damper inside the fuel rail.

More specifically, the invention provides a fuel rail assembly comprising a fuel rail and a damper assembly in the fuel rail. The damper assembly includes a damper having an end and an inner surface defining a cavity, and a sealing member at least partially received in the end and bonded to the inner surface to substantially seal the cavity. The sealing member is preferably a metal wire that includes a sealing portion bonded to the inner surface to substantially seal the cavity. The bond is preferably formed by induction brazing, and the sealing member is coated with copper to facilitate the brazing.

The invention also provides a fuel rail assembly comprising a fuel rail having a longitudinal axis and an inner wall. A damper assembly in the fuel rail includes a damper, and a spring locator coupled with the damper, the spring locator having two positioning portions outwardly biased to engage the inner wall of the fuel rail and position the damper assembly axially in the fuel rail. The spring locator is preferably a metal wire.

Most preferably, the sealing member and the spring locator are the same device that both seals the damper and locates the damper assembly inside the fuel rail.

Other features and advantages of the invention will become apparent to those skilled in the art upon review of the following detailed description, claims, and drawings.

Figure 1:
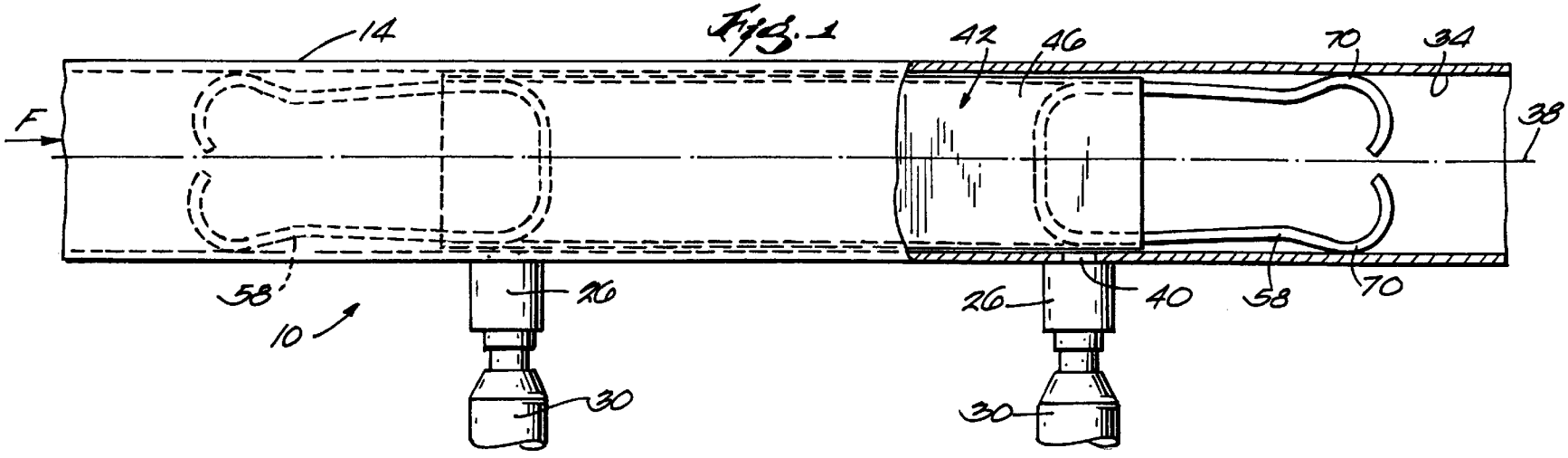
FIG. 1 illustrates a fuel rail assembly embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENT

Figure 3:
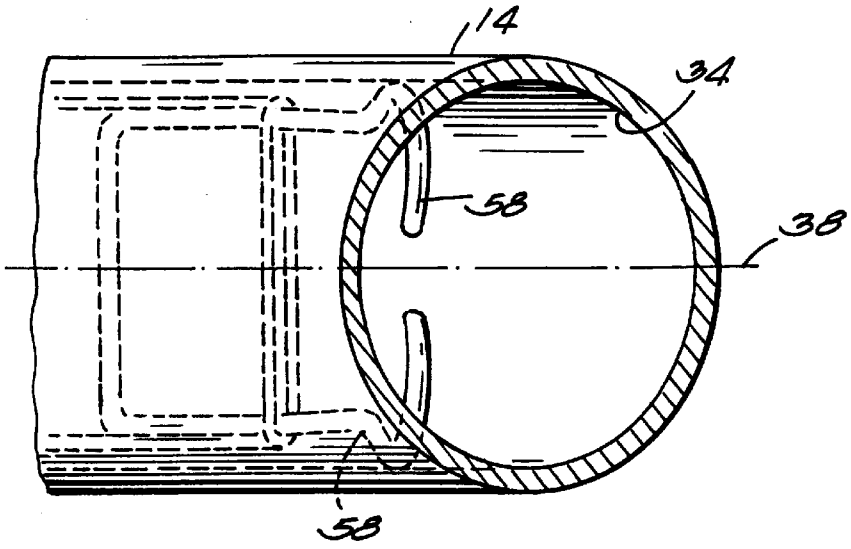
FIG. 3 is a perspective view of the damper assembly inside the fuel rail.

FIG. 1 illustrates a fuel rail assembly 10 embodying the invention. The fuel rail assembly 10 is used in internal combustion engine fuel systems utilizing fuel injection. The fuel rail assembly 10 includes a fuel rail 14 (also known as a fuel distributor tube or manifold) having a fuel inlet end and fuel outlet end. The fuel rail 14 also includes fuel injector sockets 26 that house electromagnetic fuel injectors 30. As seen in FIGS. 1 and 3, the fuel rail 14 has an inner wall 34 with a longitudinal axis 38. The inner wall 34 is preferably substantially cylindrical and includes fuel injector ports 40 corresponding to, and communicating with, the fuel injector sockets 26. The fuel rail 14 is preferably made from stainless steel, but may be made from any other suitable material.

Fuel F enters the fuel rail 14 at the fuel inlet end and flows toward the fuel outlet end. The fuel is distributed to the spaced fuel injector ports 40 and is injected into respective combustion chambers (not shown) in metered pulses by the sequential energization of the fuel injectors 30. The sequential energization results in pulsations in the fuel rail 14 that must be dampened to eliminate fuel distribution problems and fuel line hammering. Fuel rail assembly 10 can be part of a return-type system, wherein excess fuel emerges at the fuel outlet end, or a returnless or dead-headed system, wherein the fuel exits the fuel rail 14 only through the injectors 30, in which case the fuel rail 14 has no fuel outlet end.

The fuel rail assembly 10 also comprises a damper assembly 42 inside the fuel rail 14 to dampen the pulsations.

Figure 2:
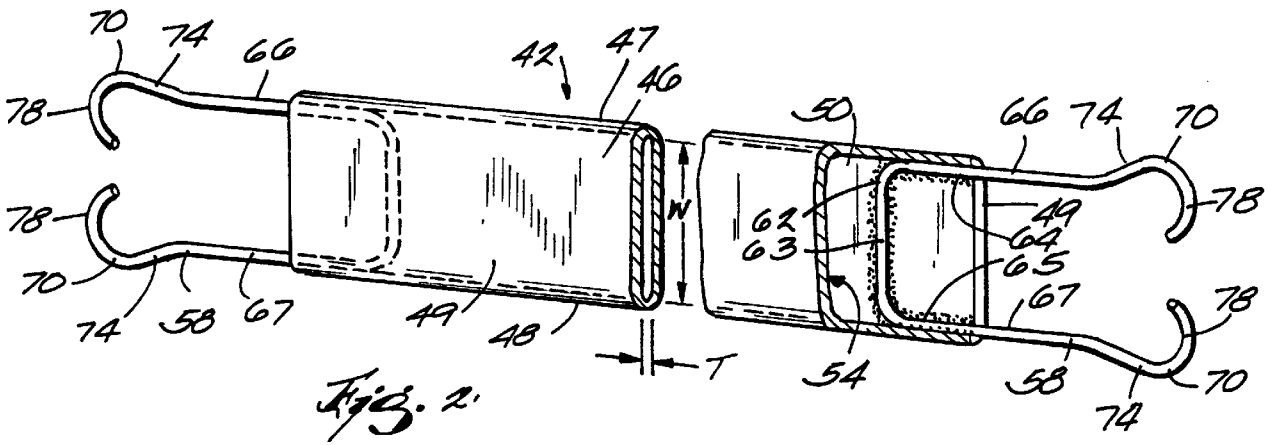
FIG. 2 is a perspective view of the damper assembly partially cut away to show the spring locator.

The damper assembly 42 includes a damper 46 having two opposite ends. The cross-sectional shape of the damper is best shown in FIG. 2. The damper 46 has semi-circular top and bottom (as seen in FIG. 2) end portions 47 and 48, respectively, connected by straight, generally parallel side walls 49. The terms "top" and "bottom" are used herein and in the claims only for convenience and are not intended to require that any portion of the damper actually be uppermost or lowermost. The end portions 47 and 48 and the side walls 49 define an inner surface 50. The portions of the inner surface 50 defined by the end portions 47 and 48 are semi-cylindrical, while the portions of the inner surface 50 defined by the walls 49 are planar. The inner surface 50 defines a hollow cavity 54 having a width W and thickness T. Relatively speaking, the width W is substantially larger than the thickness T to provide maximum flat surface area for maximum dampening.

The damper 46 is preferably a one-piece extruded metal part made of steel, and preferably, stainless steel. Using an extruded part means that the damper 46 has no longitudinal seam, has a high fatigue life and may be cut to any necessary length depending upon the length of the fuel rail 14. This minimizes production costs and makes the damper 46 substantially universal. The damper 46 should be large enough to effectively absorb the undesirable compressive forces, and should be small enough to fit into the fuel rail 14.

A metallic damper provides advantages over customary plastic or elastomeric dampers because the metallic damper does not degrade in the fuel system, and its characteristics (such as elasticity) do not change as dramatically with changes in temperature. Specifically, a stainless steel construction provides damping performance in a wider temperature range than conventional elastomeric diaphragm dampers. Elastomeric dampers may become stiff at low temperatures with resulting diminished performance, and can degrade or significantly change damping characteristics at high temperatures. Thus, the damper element of the present invention provides good performance at both high and low ambient temperatures.

Further, the stainless steel construction offers resistance to even chemically-aggressive fuels. Conventional diaphragm dampers, or other dampers utilizing elastomeric components, are subject to swelling and degradation when exposed to chemically-aggressive fuels.

The damper 46 is a uniquely shaped metallic hydraulic damper preferably having optimized volumetric compliance and strength. Volumetric compliance is the change in gas-filled cavity 54 volume as a function of applied pressure. Optimization of this characteristic to a predetermined value, constant through the operating pressure range, may be achieved by controlling design features such as cross-sectional shape, wall thickness, and material. The strength may be optimized for specific applications through the use of structural analysis such as Finite Element Analysis (FEA), as well as experimental data.

Figure 4:
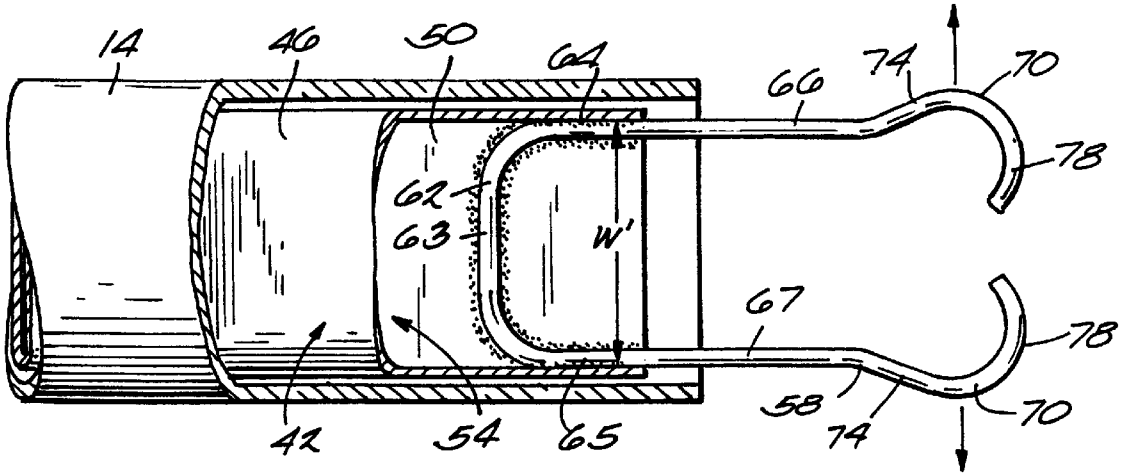
FIG. 4 is a side view of the fuel rail assembly cut away to show the spring locator being inserted.

The damper assembly 42 has a spring locator or sealing member 58 at each end. The spring locators 58 are substantially identical, and only one will be described in detail. As best seen in FIGS. 2 and 4, the spring locator 58 includes a substantially U-shaped sealing portion 62 having a cross member 63 and arms 64 and 65 extending from the opposite ends of the cross member 63. The spring locator 58 also includes two positioning portions 66 and 67 extending from the arms 64 and 65, respectively, of the sealing portion 62. The spring locator 58 is made from metal wire such as music wire or high alloy spring steel having good chemical resistance and elastic properties. The spring locator 58 is preferably made from stainless steel wire and is formed to have a spring force that biases the arms of the U-shaped sealing portion 62 and the positioning portions 66 and 67 outward or away from each other, in the direction of the arrows in FIG. 4. The spring force is constrained, and the outward bias is restricted, when the spring locator 58 is inside the damper 46 and fuel rail 14.

The wire has a diameter substantially the same as the thickness T of the cavity 54. The U-shaped sealing portion 62 has a width W' substantially the same as the width W of the cavity 54. Preferably, at least the sealing portion 62, and more preferably the entire spring locator 58, is coated with a metal or alloy having a lower melting temperature than the steel wire. Copper is preferred for the reasons described below.

The spring locator 58 is inserted into the respective end of the damper 46 such that the sealing portion 62 is in the cavity 54 and the positioning portions 66 and 67 extend from the end of the damper 46. The fit should be relatively tight such that the sealing portion 62 contacts the inner surface 50 out to the end of the damper 46. In other words, the arms 64 and 65 of the U-shaped sealing portion 62 contact the semi-cylindrical inner surfaces of the top and bottom end portions 47 and 48, respectively, while the cross member 63 contacts the inner surfaces of both side walls 49. The entire sealing portion 62 is bonded to the inner surface 50 to substantially hermetically seal the cavity 54, preventing the loss of function of the damper 46 that may occur if the cavity 54 were to fill with the fuel in which it is immersed.

Any metal-to-metal bonding technique may be used to bond the sealing portion 62 to the inner surface 50, including adhesive bonding, welding or brazing. Brazing is preferred and localized induction brazing is the most preferred. With the sealing portion 62 in contact with the inner surface 50, localized induction brazing limits the heat to the specific area of the damper 46 housing the sealing portion 62, without subjecting the entire damper 46 or spring locator 58 to excessive and prolonged heat. Under the localized heat, the copper coating at least partially transforms, through capillary action, to its molten state and bonds the sealing portion 62 to the inner surface 50, thereby substantially hermetically sealing the cavity 54. Copper is preferred due to its superior flow and bonding properties. The bond or seal is formed along substantially all points of the sealing portion 62 in contact with the inner surface 50 and extends to the end of the damper 46.

With both ends of the damper 46 sealed, the gas within the cavity 54 absorbs the pressure pulsations and minimizes the peak to peak pressure levels. Also, the gas sealed within the cavity 54 may be used as a method of quality control. Preferably, the gas is helium so that helium detection may be employed to detect leaks in the gas-filled cavity 54 after the damper 46 has been sealed. Air or other gases may also be used.

With the spring locator 58 bonded in the respective end of the damper 46, the spring force biases the positioning portions 66 and 67 outwardly as they extend from the ends of the damper 46. The positioning portions 66 and 67 include respective ramped surfaces 74 and curved surfaces 78 for facilitating insertion of the damper assembly 42 into the fuel rail 14. As used herein, the "first spring locator" refers to the spring locator 58 that enters the fuel rail 14 first upon assembly. The "second spring locator" refers to the spring locator 58 that enters the fuel rail 14 second. As the damper assembly 42 is inserted into an end of the fuel rail 14, either manually or with the aid of a starting tool (not shown), the curved surfaces 74 of the first spring locator 58 engage the end of the fuel rail 14 and undergo a cam follower-like action that forces the positioning portions 66 and 67 together. The curved surfaces 74 are specifically designed (using vector analysis) to improve the bending moment and aid in overcoming the outwardly biased spring force.

With the first spring locator 58 inserted into the fuel rail 14, the damper assembly is inserted axially into the fuel rail 14. As the second spring locator 58 enters the end of the fuel rail 14, the ramped surfaces 74 undergo a cam follower-like action that forces the positioning portions 66 and 67 together until the positioning portions 66 and 67 enter the fuel rail 14 and flex against the inner wall 34. The ramped surfaces 74 are also designed to improve the bending moment and aid in overcoming the outwardly biased spring force.

It is important to note that the insertion of the positioning portions 66 into the fuel rail 14, and the subsequent constriction endured, does not damage the bond or seal between the inner surface 50 and sealing portion 62 in any way. Bending of the positioning portions 66 and 67 begins at the end of the damper 46 and does not carry over to the brazed sealing portion 62 inside the damper 46.

The positioning portions 66 and 67 also include respective engaging portions 70. After the damper assembly 42 is inserted into the fuel rail 14, respective engaging portions 70 flex against and engage the inner wall 34. The spring force, coupled with the coefficient of friction of the inner wall 34, acts to position, center and retain the damper assembly 42 axially in the fuel rail 14. When engaged, the engaging portions 70 substantially keep the damper assembly 42 from sliding axially inside the fuel rail 14, and keep the damper assembly 42 centered in the fuel rail 14 by engaging diametrically opposed portions of the cylindrical inner wall 34. The engaging portions 70 can also be manually pressed together during insertion of the damper assembly 42 into the fuel rail 14 to deflect the positioning portions 66 and 67 and facilitate insertion.

Figure 5:
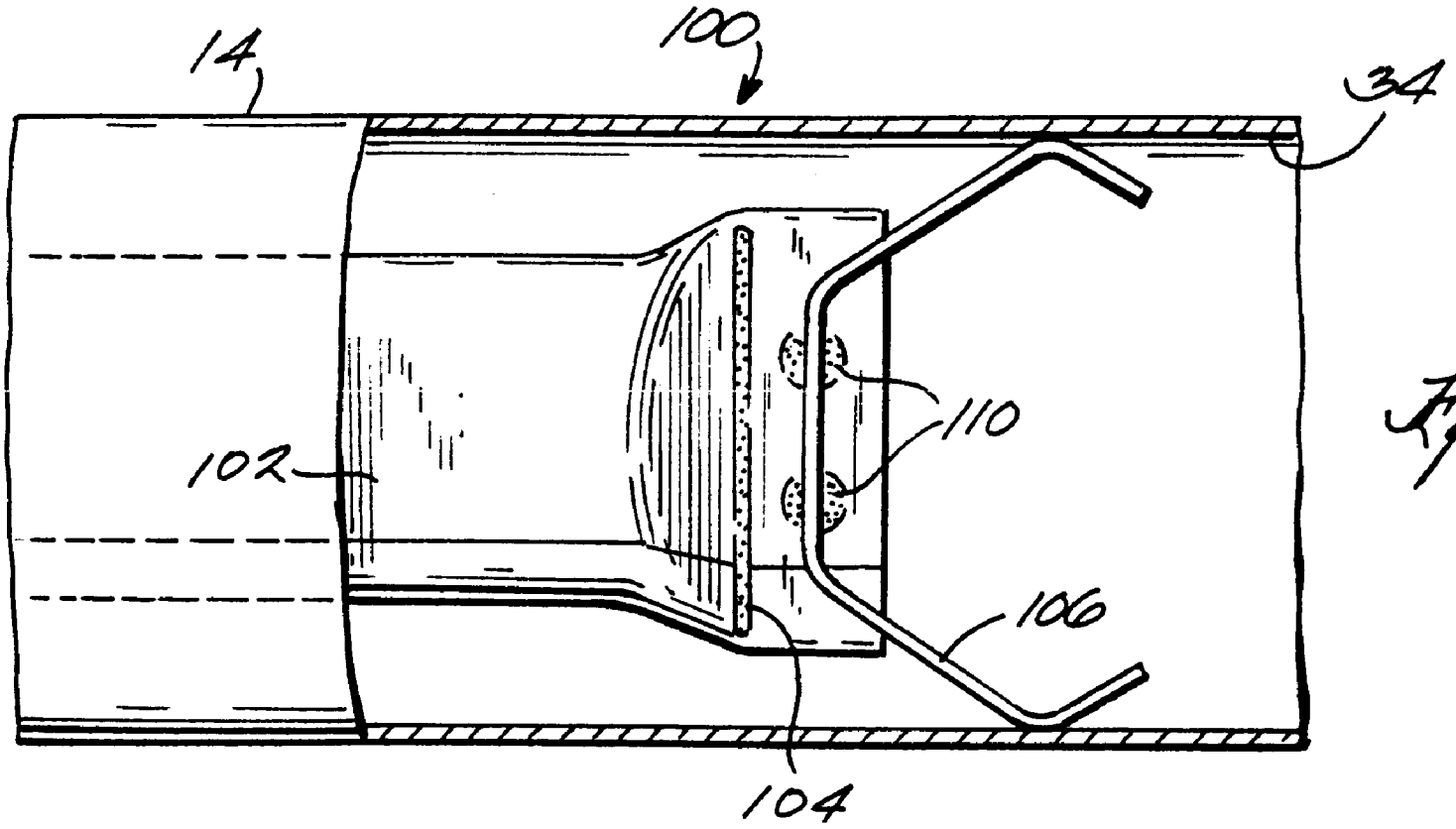
FIG. 5 is a view similar to FIG. 1 showing an alternative spring locator.

A damper assembly 100 that is an alternative embodiment of the invention is illustrated in FIG. 5. The damper assembly 100 includes a damper 102 with an end sealed by an end weld 104. The assembly 100 also includes a spring locator 106 attached to the flattened end of the damper 102 by welds 110 positioned outwardly of the end weld 104 to avoid rupturing the damper chamber.

Figure 6:
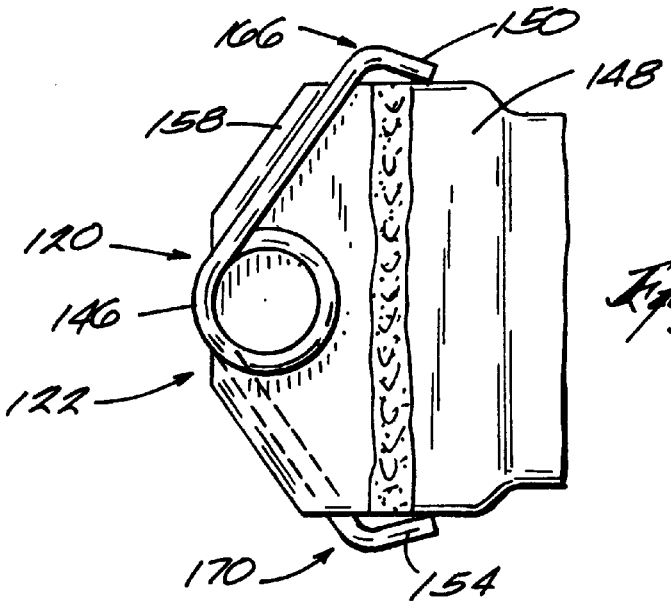
FIG. 6 illustrates a portion of a damper element with another alternative spring locator.
Figure 7:
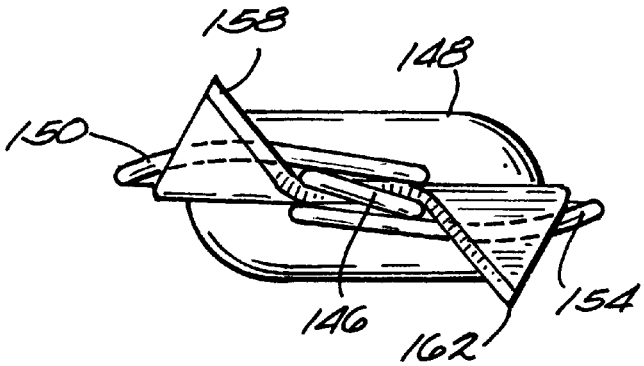
FIG. 7 is an end view of the damper element of FIG. 6.
Figure 8:
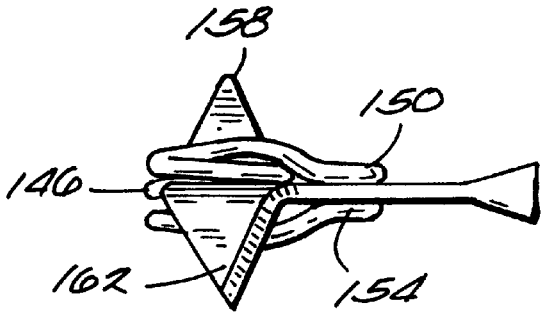
FIG. 8 is a side view of the damper element of FIG. 6.

Another alternative spring locator 120 is illustrated in FIGS. 6–8. The spring locator 120 is a wire retainer 122 formed with a central coil 146 and legs 150, 154 extending from the coil 146. The coil 146 has at least two turns. The retainer 122 is attached to the flattened end of the damper element 148 (which is similar to the damper 102) by clipping the coil 146 on the tube such that the flattened end extends between two turns of the coil 146. The flattened end of the damper element 148 includes bent portions or flanges 158, 162 that hold the retainer 122 on the end of the damper element 148. The bent portion 158 is formed by bending a portion of the flattened end in one direction (upward in FIG. 7). The bent portion 162 is formed by bending a portion of the flattened end in the opposite direction (downward in FIG. 7). The coil 146 is clipped to the flattened end between the bent portions 158, 162 such that the retainer legs 150, 154 contact the bent portions 158, 162, respectively. To remove the retainer 122 from the damper element 148, the retainer legs 150, 154 must be deflected to pass over the bent portions 158, 162. The retainer legs 150, 154 are biased outwardly and have respective curved or engaging portions 166, 170 that engage the inside wall of the fuel rail tube.

The constructions shown in FIGS. 5–8 and other alternative spring locators are further described in co-pending U.S. Ser. No. 09/449,710, which is assigned to the assignee hereof, which was filed on even date herewith, which is titled "Low Cost Hydraulic Damper Element and Method for Producing the Same," which is incorporated herein by reference.

Various features of the invention are set forth in the following claims.

What is claimed is:

1. A fuel rail assembly comprising:

a fuel rail; and a damper assembly in the fuel rail, the damper assembly including a damper having an end and an inner surface defining a cavity, and a sealing member at least partially received in the end and bonded to the inner surface to substantially seal the cavity.

2. The fuel rail assembly of claim 1, wherein the damper is extruded metal.

3. The fuel rail assembly of claim 1, wherein the sealing member is metal wire and includes a sealing portion bonded to the inner surface to substantially seal the cavity.

4. The fuel rail assembly of claim 3, wherein the sealing portion is bonded to the inner surface by induction brazing.

5. The fuel rail assembly of claim 3, wherein the sealing portion is coated with a material having a lower melting temperature than the metal wire sealing member to facilitate bonding.

6. The fuel rail assembly of claim 5, wherein the sealing portion is coated with copper.

7. The fuel rail assembly of claim 3, wherein the sealing portion is substantially U-shaped.

8. The fuel rail assembly of claim 7, wherein the cavity has a thickness and the metal wire of the U-shaped sealing portion has a diameter substantially the same as the thickness to facilitate sealing.

9. The fuel rail assembly of claim 8, wherein the cavity has a width and the U-shaped sealing portion has a width substantially the same as the cavity width to facilitate sealing.

10. The fuel rail assembly of claim 9, wherein the cavity is defined by a top portion, a bottom portion and two side walls extending between the top portion and the bottom portion, and wherein the U-shaped sealing portion includes a cross member and first and second arms extending from the cross member, the cross member being bonded to both side walls, the first arm being bonded to the top portion and the second arm being bonded to the bottom portion when the sealing portion is inserted into the damper.

11. A fuel rail assembly comprising:

a fuel rail having a longitudinal axis and an inner wall; and a damper assembly in the fuel rail, the damper assembly including a damper, and a spring locator coupled with the damper, the spring locator having two positioning portions outwardly biased to engage the inner wall and position the damper assembly axially in the fuel rail.

12. The fuel rail assembly of claim 11, wherein the damper is extruded metal.

13. The fuel rail assembly of claim 11, wherein the spring locator is metal wire.

14. The fuel rail assembly of claim 11, wherein the damper has and end, and wherein the spring locator is adjacent the end of the damper.

15. The fuel rail assembly of claim 11, wherein the two positioning portions include respective ramped surfaces for facilitating the insertion of the damper assembly into the fuel rail.

16. The fuel rail assembly of claim 11, wherein the two positioning portions include respective engaging surfaces for engaging the inner wall of the fuel rail.

17. The fuel rail assembly of claim 11, wherein the two positioning portions include respective curved surfaces for facilitating the insertion of the damper assembly into the fuel rail.

18. The fuel rail assembly of claim 11, wherein the damper has a flattened end and the spring locator further includes a center coil portion having at least two turns, the positioning portions extending from the center coil portion, and wherein the flattened end of the damper is inserted between the turns of the coil portion to connect the spring locator to the damper.

19. The fuel rail assembly of claim 18, wherein the flattened end has opposite first and second sides, opposite first and second edges, a first bent portion adjacent the first edge and bent in the direction of the first side, and a second bent portion adjacent the second edge and bent in the direction of the second side, and wherein one positioning portion extends on the first side and inside the first bent portion and the other positioning portion extends on the second side and inside the second bent portion.

20. A fuel rail assembly comprising:

a fuel rail having an axis, a fuel injector socket and an inner wall, the inner wall including a fuel injector port communicating with the fuel injector socket; and a damper assembly in the fuel rail, the damper assembly including a one-piece extruded metal damper having first and second ends and a top portion, a bottom portion and two side walls extending between the top portion and the bottom portion, the damper having an inner surface defining a hollow cavity having a thickness and a width, a first metal wire spring locator at least partially received in the first end, the first spring locator including a first substantially U-shaped copper-coated sealing portion bonded to the inner surface of the damper by induction brazing, the first sealing portion including a first cross member and first and second arms extending from the first cross member, the first cross member being bonded to both side walls, the first arm being bonded to the top portion and the second arm being bonded to the bottom portion, the first sealing portion further having a wire diameter substantially the same as the cavity thickness and a width substantially the same as the cavity width to substantially seal the cavity, and two first positioning portions extending from the first sealing portion and outward from the first end of the damper, the first positioning portions being outwardly biased to flex against and engage the inner wall of the fuel rail to position the damper assembly axially in the fuel rail; and a second metal wire spring locator at least partially received in the second end, the second spring locator including a second substantially U-shaped copper-coated sealing portion bonded to the inner surface of the damper by induction brazing, the second sealing member including a second cross member and first and second arms extending from the second cross member, the second cross member being bonded to both side walls, the first arm being bonded to the top portion and the second arm being bonded to the bottom portion, the second sealing portion further having a wire diameter substantially the same as the cavity thickness and a width substantially the same as the cavity width to substantially seal the cavity, and two first positioning portions extending from the second sealing portion and outward from the second end of the damper, the second positioning portions being outwardly biased to flex against and engage the inner wall of the fuel rail to position the damper assembly axially in the fuel rail.

21. A method of assembling a fuel rail, the method comprising:

inserting a sealing member into one end of a damper having an inner surface;

bonding the sealing member to the inner surface to substantially seal the end of the damper; and inserting the damper and the sealing member into a fuel rail.

22. The method of claim 21, wherein induction brazing is used to perform the bonding.

23. The method of claim 21, further including coating a portion of the sealing member with a material having a lower melting temperature than the sealing member prior to bonding.

24. The method of claim 21, wherein the fuel rail has an inner wall, the method further including providing the sealing member with two outwardly biased positioning portions extending from the end of the damper so that the positioning portions engage the inner wall and position the damper assembly axially in the fuel rail.

* * * * *